US010260265B2

(12) United States Patent
Heater

(10) Patent No.: US 10,260,265 B2
(45) Date of Patent: Apr. 16, 2019

(54) APPLIANCE DOOR ASSEMBLY

(71) Applicant: WHIRLPOOL CORPORATION, Benton Harbor, MI (US)

(72) Inventor: Timothy Heater, Hartford, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/687,731

(22) Filed: Aug. 28, 2017

(65) Prior Publication Data

US 2018/0135343 A1 May 17, 2018

Related U.S. Application Data

(60) Provisional application No. 62/425,985, filed on Nov. 23, 2016, provisional application No. 62/422,988, filed on Nov. 16, 2016.

(51) Int. Cl.

| | |
|---|---|
| ***D06F 37/28*** | (2006.01) |
| ***D06F 39/14*** | (2006.01) |
| ***D06F 58/20*** | (2006.01) |
| ***E05D 15/50*** | (2006.01) |
| ***E05D 15/52*** | (2006.01) |

(52) U.S. Cl.

CPC ..... *E05D 15/507* (2013.01); *D06F 37/28* (2013.01); *D06F 39/14* (2013.01); *E05D 15/505* (2013.01); *E05D 15/52* (2013.01); *D06F 58/20* (2013.01); *E05Y 2900/312* (2013.01); *F25D 2323/022* (2013.01)

(58) Field of Classification Search

CPC ..... D06F 37/28; D06F 39/14; D06F 58/20; E05D 15/505; E05D 15/507; E05D 15/52; F25D 2323/022

USPC ..... 68/4, 12.02, 12.18, 12.26, 17 R

See application file for complete search history.

(56) References Cited

U.S. PATENT DOCUMENTS

| | | | |
|---|---|---|---|
| 2,885,723 | A | 5/1959 | Altmann |
| 2,899,717 | A | 8/1959 | Billings et al. |
| 3,018,508 | A | 1/1962 | Keeling, Sr. |
| 3,321,100 | A | 5/1967 | Toma |
| 8,196,441 | B2 | 6/2012 | Hendrickson et al. |
| 8,388,695 | B2 | 3/2013 | Hendrickson et al. |
| 8,397,328 | B2 | 3/2013 | Hendrickson et al. |
| 8,397,544 | B2 | 3/2013 | Hendrickson |
| 8,438,881 | B2 | 5/2013 | Ihne et al. |
| 8,733,802 | B2 | 5/2014 | Promutico et al. |
| 8,813,526 | B2 | 8/2014 | Doyle et al. |

(Continued)

FOREIGN PATENT DOCUMENTS

| | | | |
|---|---|---|---|
| DE | 102009044126 | B3 | 11/2010 |
| EP | 2743393 | A1 | 6/2014 |

(Continued)

OTHER PUBLICATIONS

European Search Report for Counterpart EP17199521.0, dated Feb. 23, 2018.

*Primary Examiner* — Levon J Shahinian
(74) *Attorney, Agent, or Firm* — McGarry Bair PC

(57) ABSTRACT

A laundry appliance including a chassis with a cabinet enclosing an interior of the appliance. A tub is provided within the appliance defining a liquid chamber. A drum is provided in the liquid chamber defining a treating chamber for treating articles according to a cycle of operation. The treating chamber can be enclosed by a door, selectively openable by a user to access the treating chamber. The door can be selectively opened in three different ways.

20 Claims, 8 Drawing Sheets

(56) References Cited

U.S. PATENT DOCUMENTS

| | | | |
|---|---|---|---|
| 9,435,068 | B2 | 9/2016 | Kang et al. |
| 2010/0000264 | A1 | 1/2010 | Luckman et al. |
| 2012/0187811 | A1 | 7/2012 | Kim et al. |
| 2012/0217851 | A1 | 8/2012 | Bae et al. |
| 2015/0233042 | A1 | 8/2015 | Kang et al. |

FOREIGN PATENT DOCUMENTS

| | | | |
|---|---|---|---|
| KR | 20150131532 | A | 11/2015 |
| WO | 2015130247 | A1 | 9/2015 |

APPLIANCE DOOR ASSEMBLY

CROSS-REFERENCE TO RELATED APPLICATION(S)

This application claims priority to U.S. Provisional Patent Application No. 62/422,988, filed Nov. 16, 2016, and U.S. Provisional Patent Application No. 62/425,985 filed Nov. 23, 2016, both of which are incorporated herein by reference in their entirety.

BACKGROUND

A household appliance commonly has a cabinet defining an interior that is accessible through a door. The door is traditionally opened with a handle member in a single direction about a single pivotable axis.

In a typical washer and dryer appliance organization, the washer is placed on the left and the dryer is place on the right from the perspective of a user facing the machines. This set up enables a user to move between the opened doors between the two machines. However, such a setup is not always possible or desirable, based upon the environment in which the appliances are placed. When not possible, the direction that the doors of the appliances open can be inconvenient or interfere with use of the appliances.

Some manufacturers permit consumers or user to request a change in the direction of how the door opens. However, this request is time consuming and undesirable to consumers.

BRIEF SUMMARY

In one aspect, the disclosure relates to a laundry treating appliance including a cabinet defining an interior and having a front access opening. A drum is provided in the interior defining a treating chamber accessible through the access opening. A door assembly selectively opens and closes the access opening and includes a first door pivotable about a left-side vertical axis and a right-side vertical axis, and a second door provided within and partially forming the first door, pivotable about a horizontal axis.

In another aspect, the disclosure relates to a laundry treating appliance including a cabinet defining an interior having an access opening and a drum provided within the interior defining a treating chamber accessible through the access opening. A door assembly selectively opens and closes the access opening and includes a first door pivotable about a first axis and a second axis, and a second door pivotable about a third axis.

In yet another aspect, the disclosure relates to a three-way door assembly for opening and closing an appliance in three directions, and including a cabinet defining an interior and including an access opening for accessing the interior. A first door is pivotable about a left-side vertical axis and a right-side vertical axis. A second door is provided within the first door and is pivotable about a horizontal axis.

DETAILED DESCRIPTION

Systems, components, and methodologies in accordance with the present disclosure enable a manufacturer of a laundry treating appliance to assemble the laundry treating appliance with greater ease and efficiency. Modern laundry treating appliances only open doors in a single direction. A user is at the mercy of the singular opening direction of the appliance, which can be difficult or inconvenient.

Systems, components, and methodologies in accordance with the present disclosure provide a door that can open in a three different directions, at the discretion of the user. The user need not change or mechanically alter the door in order to enable opening in the different directions.

The door as described herein in relation to a washing machine laundry treating appliance for treating fabric articles according to a cycle of operation. It should be appreciated, however, that the door as described herein is not so limited and can have equal applicability to additional appliances, such as a dishwasher, a dryer, or stove in non-limiting examples. Other appliances utilizing the door can be of different sizes or configurations, accessing a treating chamber as may be desirable to a user.

Figure 1:
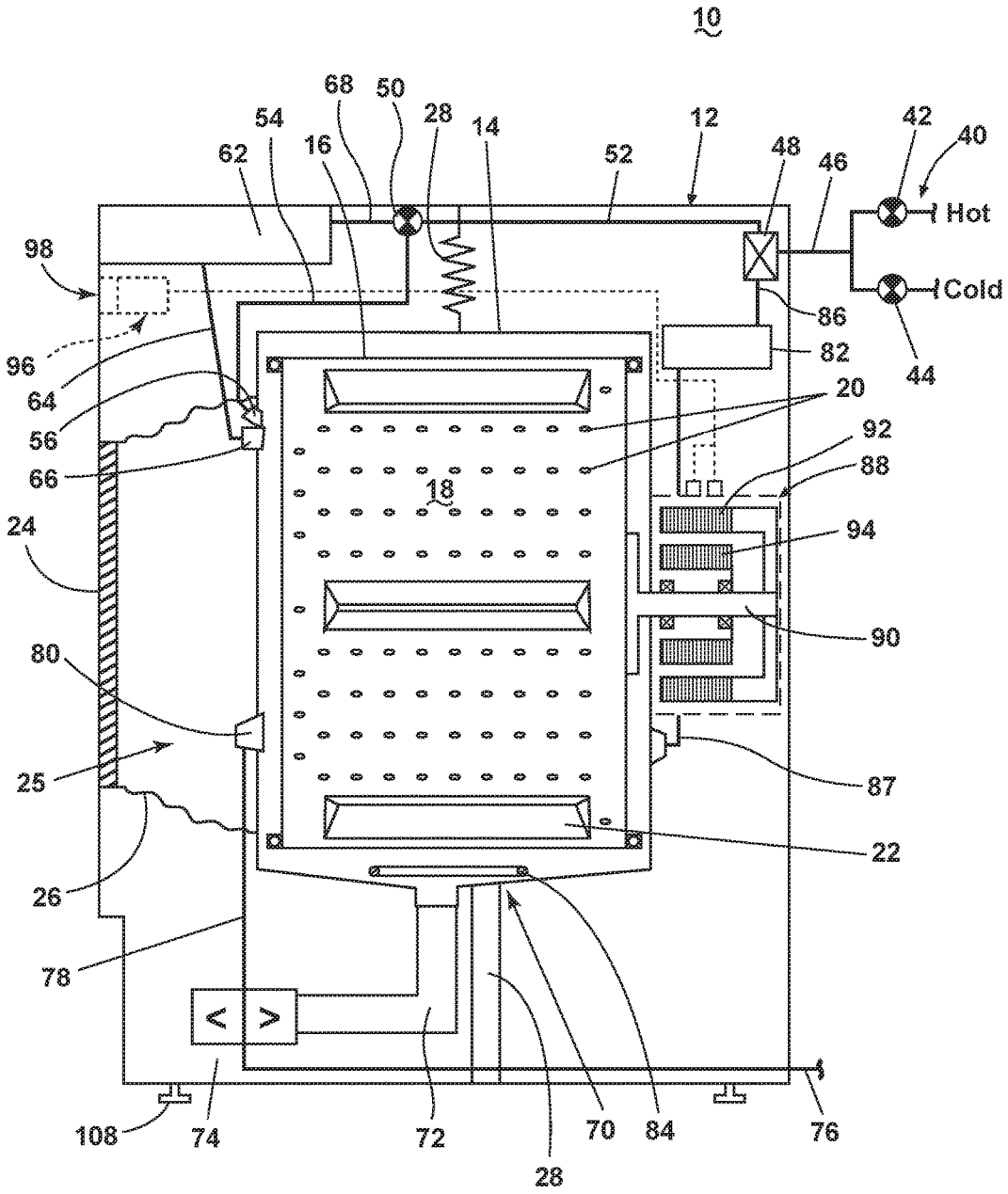
FIG. 1 is a schematic view of a laundry treating appliance in the form of a washing machine according to a first embodiment of the invention.

FIG. 1 is a schematic view of a laundry treating appliance according to a first aspect of the disclosure. The laundry treating appliance may be any appliance which performs a cycle of operation to clean or otherwise treat items placed therein, non-limiting examples of which include a horizontal or vertical axis clothes washer; a combination washing machine and dryer; a tumbling or stationary refreshing/revitalizing machine; an extractor; a non-aqueous washing apparatus; and a revitalizing machine.

The laundry treating appliance of FIG. 1 is illustrated as a washing machine 10, which may include a structural support system comprising a chassis or cabinet 12 which defines a housing within which a laundry holding system resides. The cabinet 12 may be a housing having a chassis and/or a frame, defining an interior enclosing components typically found in a conventional washing machine, such as motors, pumps, fluid lines, controls, sensors, transducers, and the like. Such components will not be described further herein except as necessary for a complete understanding of the disclosure.

The laundry holding system comprises a tub 14 supported within the cabinet 12 by a suitable suspension system and a drum 16 provided within the tub 14, the drum 16 defining at least a portion of a laundry treating chamber 18. The drum 16 may include a plurality of perforations 20 such that liquid may flow between the tub 14 and the drum 16 through the perforations 20. A plurality of baffles 22 may be disposed on an inner surface of the drum 16 to lift the laundry load received in the treating chamber 18 while the drum 16 rotates. It is also within the scope of the disclosure for the laundry holding system to comprise only a tub with the tub defining the laundry treating chamber.

The laundry holding system may further include a door 24 which may be movably mounted to the cabinet 12 to selectively close both the tub 14 and the drum 16 at an access opening 25. A bellows 26 may couple the access opening 25 of the tub 14 with the cabinet 12, with the door 24 sealing against the bellows 26 when the door 24 closes the tub 14.

The washing machine 10 may further include a suspension system 28 for dynamically suspending the laundry holding system within the structural support system.

The washing machine 10 may further include a liquid supply system for supplying water to the washing machine 10 for use in treating laundry during a cycle of operation. The liquid supply system may include a source of water, such as a household water supply 40, which may include separate valves 42 and 44 for controlling the flow of hot and cold water, respectively. Water may be supplied through an inlet conduit 46 directly to the tub 14 by controlling first and second diverter mechanisms 48 and 50, respectively. The diverter mechanisms 48, 50 may be a diverter valve having two outlets such that the diverter mechanisms 48, 50 may selectively direct a flow of liquid to one or both of two flow paths. Water from the household water supply 40 may flow through the inlet conduit 46 to the first diverter mechanism 48 which may direct the flow of liquid to a supply conduit 52. The second diverter mechanism 50 on the supply conduit 52 may direct the flow of liquid to a tub outlet conduit 54 which may be provided with a spray nozzle 56 configured to spray the flow of liquid into the tub 14. In this manner, water from the household water supply 40 may be supplied directly to the tub 14.

The washing machine 10 may also be provided with a dispensing system for dispensing treating chemistry to the treating chamber 18 for use in treating the laundry according to a cycle of operation. The dispensing system may include a dispenser 62 which may be a single use dispenser, a bulk dispenser or a combination of a single and bulk dispenser. Non-limiting examples of suitable dispensers are disclosed in U.S. Pat. No. 8,196,441 to Hendrickson et al., filed Jul. 1, 2008, entitled "Household Cleaning Appliance with a Dispensing System Operable Between a Single Use Dispensing System and a Bulk Dispensing System," U.S. Pat. No. 8,388,695 to Hendrickson et al., filed Jul. 1, 2008, entitled "Apparatus and Method for Controlling Laundering Cycle by Sensing Wash Aid Concentration," U.S. Pat. No. 8,397,328 to Hendrickson et al., filed Jul. 1, 2008, entitled "Apparatus and Method for Controlling Concentration of Wash Aid in Wash Liquid," U.S. Pat. No. 8,813,526 to Doyle et al., filed Jul. 1, 2008, entitled "Water Flow Paths in a Household Cleaning Appliance with Single Use and Bulk Dispensing," U.S. Pub. No. 2010/0000264 to Luckman et al., filed Jul. 1, 2008, entitled "Method for Converting a Household Cleaning Appliance with a Non-Bulk Dispensing System to a Household Cleaning Appliance with a Bulk Dispensing System," U.S. Pat. No. 8,397,544 to Hendrickson, filed Jun. 23, 2009, entitled "Household Cleaning Appliance with a Single Water Flow Path for Both Non-Bulk and Bulk Dispensing," and U.S. Pat. No. 8,438,881, filed Apr. 25, 2011, entitled "Method and Apparatus for Dispensing Treating Chemistry in a Laundry Treating Appliance," which are herein incorporated by reference in full.

Regardless of the type of dispenser used, the dispenser 62 may be configured to dispense a treating chemistry directly to the tub 14 or mixed with water from the liquid supply system through a dispensing outlet conduit 64. The dispensing outlet conduit 64 may include a dispensing nozzle 66 configured to dispense the treating chemistry into the tub 14 in a desired pattern and under a desired amount of pressure. For example, the dispensing nozzle 66 may be configured to dispense a flow or stream of treating chemistry into the tub 14 by gravity, i.e. a non-pressurized stream. Water may be supplied to the dispenser 62 from the supply conduit 52 by directing the diverter mechanism 50 to direct the flow of water to a dispensing supply conduit 68.

Non-limiting examples of treating chemistries that may be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The washing machine 10 may also include a recirculation and drain system for recirculating liquid within the laundry holding system and draining liquid from the washing machine 10. Liquid supplied to the tub 14 through tub outlet conduit 54 and/or the dispensing supply conduit 68 typically enters a space between the tub 14 and the drum 16 and may flow by gravity to a sump 70 formed in part by a lower portion of the tub 14. The sump 70 may also be formed by a sump conduit 72 that may fluidly couple the lower portion of the tub 14 to a pump 74. The pump 74 may direct liquid to a drain conduit 76, which may drain the liquid from the washing machine 10, or to a recirculation conduit 78, which may terminate at a recirculation inlet 80. The recirculation inlet 80 may direct the liquid from the recirculation conduit 78 into the drum 16. The recirculation inlet 80 may introduce the liquid into the drum 16 in any suitable manner, such as by spraying, dripping, or providing a steady flow of liquid. In this manner, liquid provided to the tub 14, with or without treating chemistry may be recirculated into the treating chamber 18 for treating the laundry within.

The liquid supply and/or recirculation and drain system may be provided with a heating system which may include one or more devices for heating laundry and/or liquid supplied to the tub 14, such as a steam generator 82 and/or a sump heater 84. Liquid from the household water supply 40 may be provided to the steam generator 82 through the inlet conduit 46 by controlling the first diverter mechanism 48 to direct the flow of liquid to a steam supply conduit 86. Steam generated by the steam generator 82 may be supplied to the tub 14 through a steam outlet conduit 87. The steam generator 82 may be any suitable type of steam generator such as a flow through steam generator or a tank-type steam generator. Alternatively, the sump heater 84 may be used to generate steam in place of or in addition to the steam generator 82. In addition or alternatively to generating steam, the steam generator 82 and/or sump heater 84 may be used to heat the laundry and/or liquid within the tub 14 as part of a cycle of operation.

Additionally, the liquid supply and recirculation and drain system may differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry.

The washing machine 10 also includes a drive system for rotating the drum 16 within the tub 14. The drive system may include a motor 88, which may be directly coupled with the drum 16 through a drive shaft 90 to rotate the drum 16 about a rotational axis during a cycle of operation. The motor 88 may be a brushless permanent magnet (BPM) motor having a stator 92 and a rotor 94. Alternately, the motor 88 may be coupled to the drum 16 through a belt and a drive shaft to rotate the drum 16, as is known in the art. Other motors, such as an induction motor or a permanent split capacitor (PSC) motor, may also be used. The motor 88 may rotate the drum 16 at various speeds in either rotational direction.

The washing machine 10 also includes a control system for controlling the operation of the washing machine 10 to implement one or more cycles of operation. The control system may include a controller 96 located within the cabinet 12 and a user interface 98 that is operably coupled with the controller 96. The user interface 98 may include one or more knobs, dials, switches, displays, touch screens and the like for communicating with the user, such as to receive input and provide output. The user may enter different types of information including, without limitation, cycle selection and cycle parameters, such as cycle options.

The controller 96 may include the machine controller and any additional controllers provided for controlling any of the components of the washing machine 10. For example, the controller 96 may include the machine controller and a motor controller. Many known types of controllers may be used for the controller 96. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), may be used to control the various components.

Figure 2:
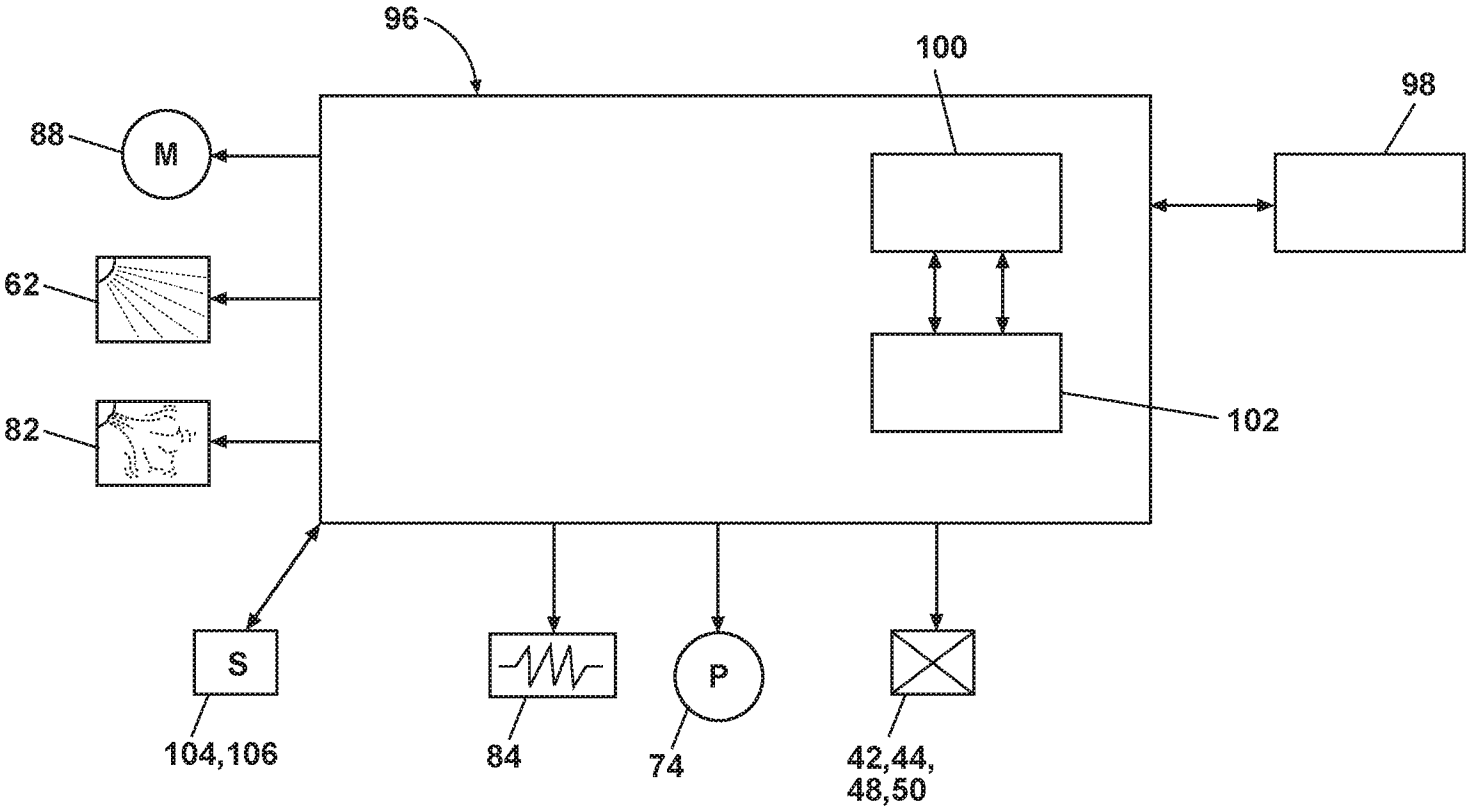
FIG. 2 is a schematic of a control system of the laundry treating appliance of FIG. 1 according to the first embodiment of the invention.

As illustrated in FIG. 2, the controller 96 may be provided with a memory 100 and a central processing unit (CPU) 102. The memory 100 may be used for storing the control software that is executed by the CPU 102 in completing a cycle of operation using the washing machine 10 and any additional software. Examples, without limitation, of cycles of operation include: wash, heavy duty wash, delicate wash, quick wash, pre-wash, refresh, rinse only, and timed wash. The memory 100 may also be used to store information, such as a database or table, and to store data received from one or more components of the washing machine 10 that may be communicably coupled with the controller 96. The database or table may be used to store the various operating parameters for the one or more cycles of operation, including factory default values for the operating parameters and any adjustments to them by the control system or by user input.

The controller 96 may be operably coupled with one or more components of the washing machine 10 for communicating with and controlling the operation of the component to complete a cycle of operation. For example, the controller 96 may be operably coupled with the motor 88, the pump 74, the dispenser 62, the steam generator 82 and the sump heater 84 to control the operation of these and other components to implement one or more of the cycles of operation.

The controller 96 may also be coupled with one or more sensors 104 provided in one or more of the systems of the washing machine 10 to receive input from the sensors, which are known in the art and not shown for simplicity. Non-limiting examples of sensors 104 that may be communicably coupled with the controller 96 include: a treating chamber temperature sensor, a moisture sensor, a weight sensor, a chemical sensor, a position sensor and a motor torque sensor, which may be used to determine a variety of system and laundry characteristics, such as laundry load inertia or mass.

In one example, one or more load amount sensors 106 may also be included in the washing machine 10 and may be positioned in any suitable location for detecting the amount of laundry, either quantitative (inertia, mass, weight, etc.) or qualitative (small, medium, large, etc.) within the treating chamber 18. By way of non-limiting example, it is contemplated that the amount of laundry in the treating chamber may be determined based on the weight of the laundry and/or the volume of laundry in the treating chamber. Thus, the one or more load amount sensors 106 may output a signal indicative of either the weight of the laundry load in the treating chamber 18 or the volume of the laundry load in the treating chamber 18.

The one or more load amount sensors 106 may be any suitable type of sensor capable of measuring the weight or volume of laundry in the treating chamber 18. Non-limiting examples of load amount sensors 106 for measuring the weight of the laundry may include load volume, pressure, or force transducers which may include, for example, load cells and strain gauges. It has been contemplated that the one or more such sensors 106 may be operably coupled to the suspension system 28 to sense the weight borne by the suspension system 28. The weight borne by the suspension system 28 correlates to the weight of the laundry loaded into the treating chamber 18 such that the sensor 106 may indicate the weight of the laundry loaded in the treating chamber 18. In the case of a suitable sensor 106 for determining volume it is contemplated that an IR or optical based sensor may be used to determine the volume of laundry located in the treating chamber 18.

Alternatively, it has been contemplated that the washing machine 10 may have one or more pairs of feet 108 extending from the cabinet 12 and supporting the cabinet 12 on the floor and that a weight sensor (not shown) may be operably coupled to at least one of the feet 108 to sense the weight borne by that foot 108, which correlates to the weight of the laundry loaded into the treating chamber 18. In another example, the amount of laundry within the treating chamber 18 may be determined based on motor sensor output, such as output from a motor torque sensor. The motor torque is a function of the inertia of the rotating drum and laundry. There are many known methods for determining the load inertia, and thus the load mass, based on the motor torque. It will be understood that any suitable method and sensors may be used to determine the amount of laundry.

Figure 3:
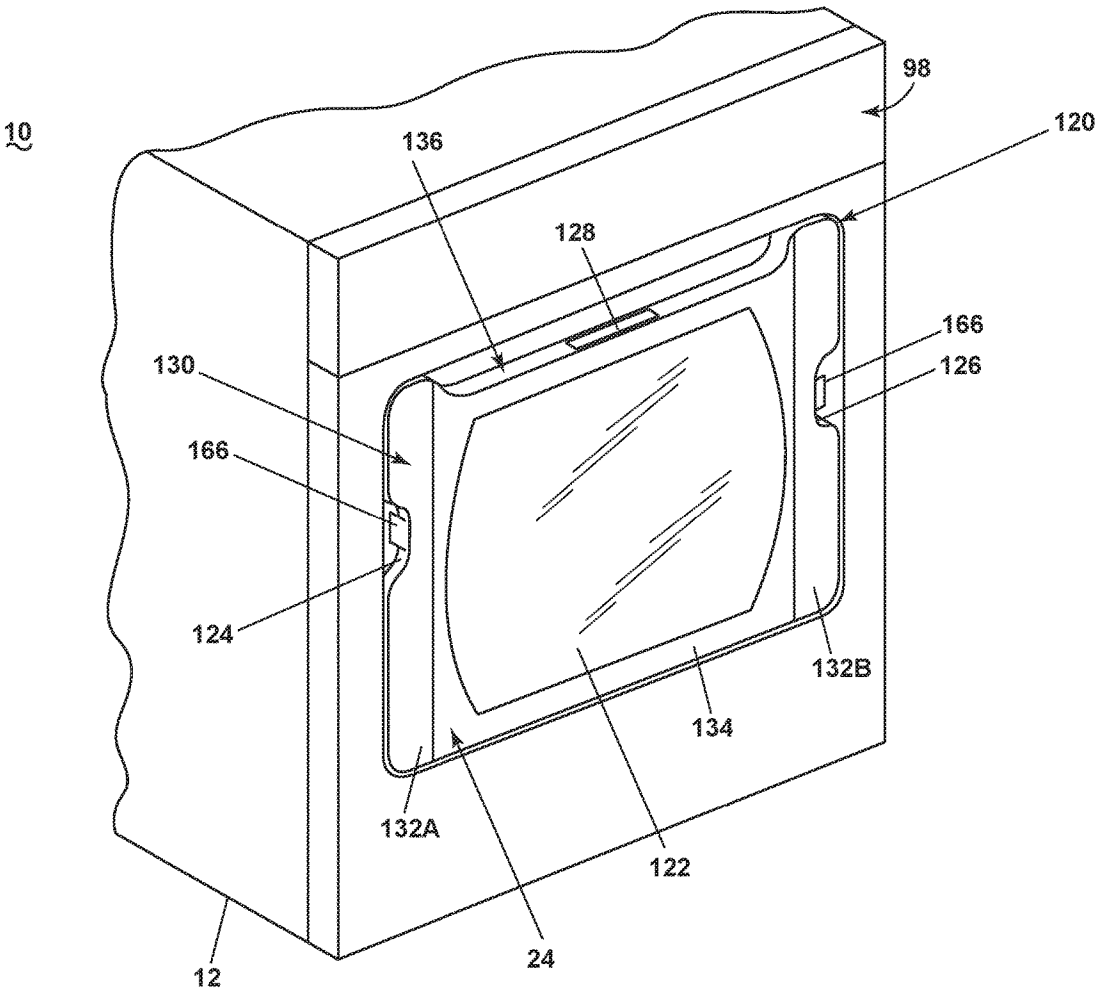
FIG. 3 is a perspective schematic view of a door of a washing machine openable in three different directions.

Referring now to FIG. 3, the door 24 of the washing machine 10 is a three-way door 120 provided on the front of the cabinet 12 of a fabric treating appliance. While not necessary, as illustrated, the three-way door 120 is positioned underneath the user interface 98. The three-way door 120 can include a window 122 providing visual inspection of the treating chamber 18 (FIG. 1). The three-way door 120 includes a primary door 130 defining a frame for a secondary door 134. The primary door 130 is dual-hingedly mounted to the cabinet 12 permitting opening both from right-to-left or left-to-right at the user's preference. The secondary door 134 hingedly mounts to the primary door 130 and pivots downward relative to the primary door 130.

The primary door 130 includes two handles 132A, 132B, with the handles 132A, 132B at least partially defining the frame for the secondary door 134 and positioned on opposing sides of the secondary door 134. The three-way door 120 includes three hand openings, with a left hand opening 124 provided on the left handle 132A, a right hand opening 126 provided on the right handle 132B, and a top hand opening 128. The left hand opening 124 and the right hand opening 126 provide access to an actuator, such as lever 166, for selectively opening the door from either side. The window 122 and the top hand opening 128 can be provided in the secondary door 134. The secondary door 134 can include a recessed area 136, providing access to the top hand opening 128 to assist the user in opening the secondary door 134. While not shown, the recessed area 136 can facilitate access to the top hand opening 128 by a user similar to how the left and right hand openings 124, 126 provide access to the levers 166.

Figure 4:
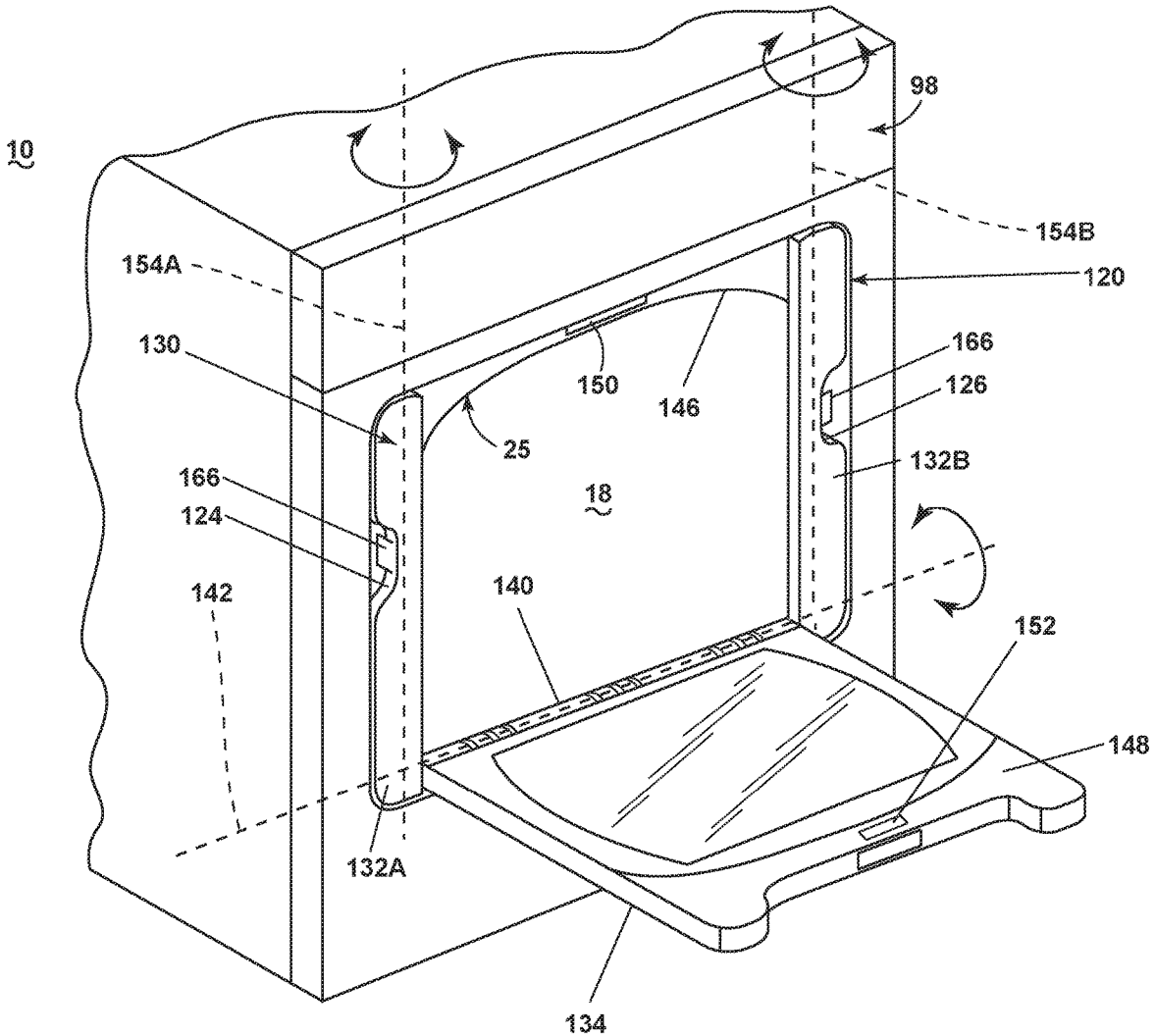
FIG. 4 is a perspective view of the door of FIG. 3 in an opened position, illustrating the three rotational axes that can open the door in three different directions.

Referring now to FIG. 4, the three-way door 120 of FIG. 3 is shown with the secondary door 134 in a horizontal, opened position, with the secondary door 134 rotated downward. A horizontal hinge 140 is shown at the bottom of the secondary door 134, attaching the secondary door 134 to the primary door 130 at the handles 132A, 132B. The secondary door 134 is pivotable about the horizontal hinge 140 along a horizontal axis 142 to open or close the secondary door 134 in a forward and backward manner. The horizontal hinge 140 can be damped, preventing a free-fall of the door when opening.

Visible in the opened position of the secondary door 134 is the access opening 25 providing access to the treating chamber 18. The access opening 25 is at least partially defined by an upper terminal surface 146. A seal 148 is provided on the rear of the secondary door 134 for sealing the treating chamber 18 at the upper terminal surface 146. A latch system can be used to selectively open and close the secondary door 134, using a strike and catch system. A strike 150 can be provided on the upper terminal surface 146 and a complementary catch 152 is provided on a rear side of the secondary door 134. In one example, the strike 150 can be a magnetic plate, and the catch 152 can be a magnet. While the strike 150 is shown on the access opening 25, and the catch 152 on the secondary door 134, it is contemplated that the three-way door 120 should not be so limited and can use any stroke and catch system with any setup. The strike 150 and catch 152 provide for pull and push, opening and closing for the secondary door 134. With the stroke and catch system, no button or actuation is required to access the treating chamber 18 by the user, simplifying operation and reducing overall cost. While the strike 150 is provided on the terminal surface 146 and the catch 152 is provided on the three-way door 120, it should be appreciated that such an arrangement is not limiting, and any push/pull operated latch system can be used to open and close the secondary door 134. Furthermore, it should be understood that a button system, such as an actuable handle, or even an electronic locking system or opening system is also contemplated for opening and closing the secondary door 134.

Two rotational axes 154A, 154B can be defined through the handles 132A, 132B. The rotational axes 154A, 154B can be defined along two hinges provided in the handles 132A, 132B (see FIGS. 5A-5D). The three-way door 120 is pivotable about the rotational axes 154A, 154B, to selectively open or close the access opening 25 by moving the door in a left-to-right direction or a right-to-left direction. Conveniently, the rotational axes 154A, 154B are oriented vertically.

The left and right hand openings 124, 126 can be positioned adjacent the handles 132A, 132B, with a left-side rotational axis 154A defined at a left-side handle 132A adjacent the left side hand opening 124, and a right side rotational axis 154B defined at a right-side handle 132B adjacent the right side hand opening 126, and a horizontal hinge 140 at the bottom of the three-way door 120. The three axes 142, 154A, 154B enable the opening of the three-way door 120 in three directions.

Figure 5A:
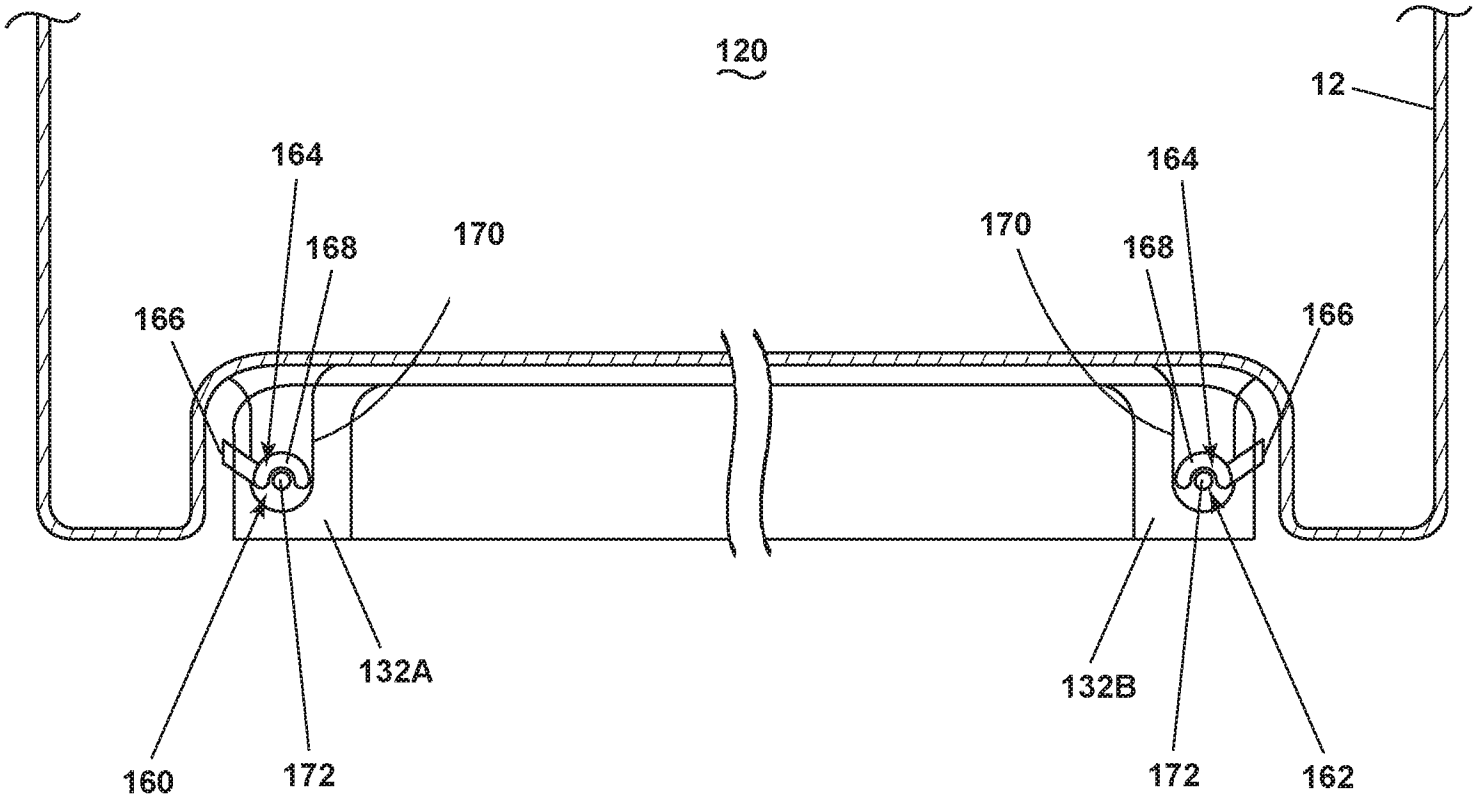
FIG. 5A is a top view of the door of FIG. 3 in a closed position.

Referring now to FIG. 5A, a top-down view of the three-way door 120 of FIG. 3 is shown, having a left-side hinge assembly 160 provided in the left side handle 132A, and right-side hinge assembly 162 provided on the right side handle 132B. Each handle 132A, 132B can selectively couple or de-couple at the hinge assemblies 160, 162 to enable opening of the three-way door 120 from right-to-left or left-to-right.

A hinge pin 172 couples to the cabinet 12 at an arm 170. The handles 132A, 132B can be adapted such that the hinge pin 172 extends through the handles 132A, 132B. The hinge assemblies 160, 162 releasably mount the primary door 130 to the cabinet 12 at the hinge pin 172. Each handle 132A, 132B includes an actuator assembly 164 having the lever 166 coupled to a cam 168. The actuator assembly 164 can selectively couple or de-couple to or form the hinge pin 172 by actuating the lever 166 to pivotably release the cam 168 from the hinge pin 172. Upon depression of the lever 166, the cam 168 rotates away from the hinge pin 172 to decouple the hinge assembly 160 from the cabinet 12 and enable opening of the three-way door 120 from the handle 132A, 132B.

Figure 5B:
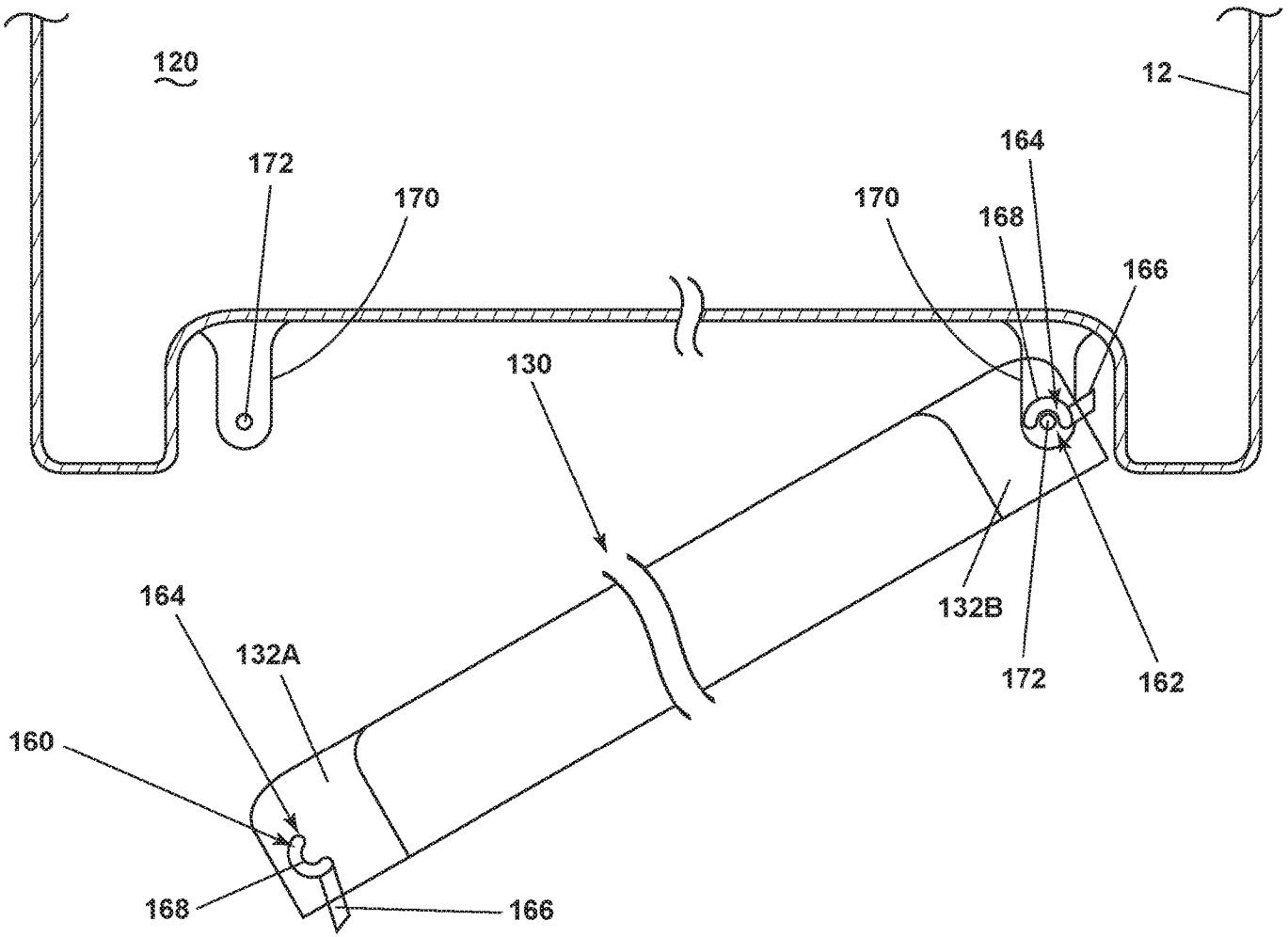
FIG. 5B is a top view of the door of FIG. 5A in an opened position, pivoted about a right-side axis.

Referring now to FIG. 5B, the left-side hinge assembly 160 has been selectively de-coupled form the hinge pin 172 at the left side of the three-way door 120. Depression of the lever 166 actuates the cam 168 to rotatably detach from the hinge pin 172. The de-coupled cam 168 releases the hinge pin 172 and permits pivoting movement of the three-way door 120 about the hinge pin 172 at the right side hinge assembly 162. Thus, the user can actuate the lever 166 on the left-side hinge assembly 160 to open the three-way door 120 in a direction from left-to-right.

Figure 5C:
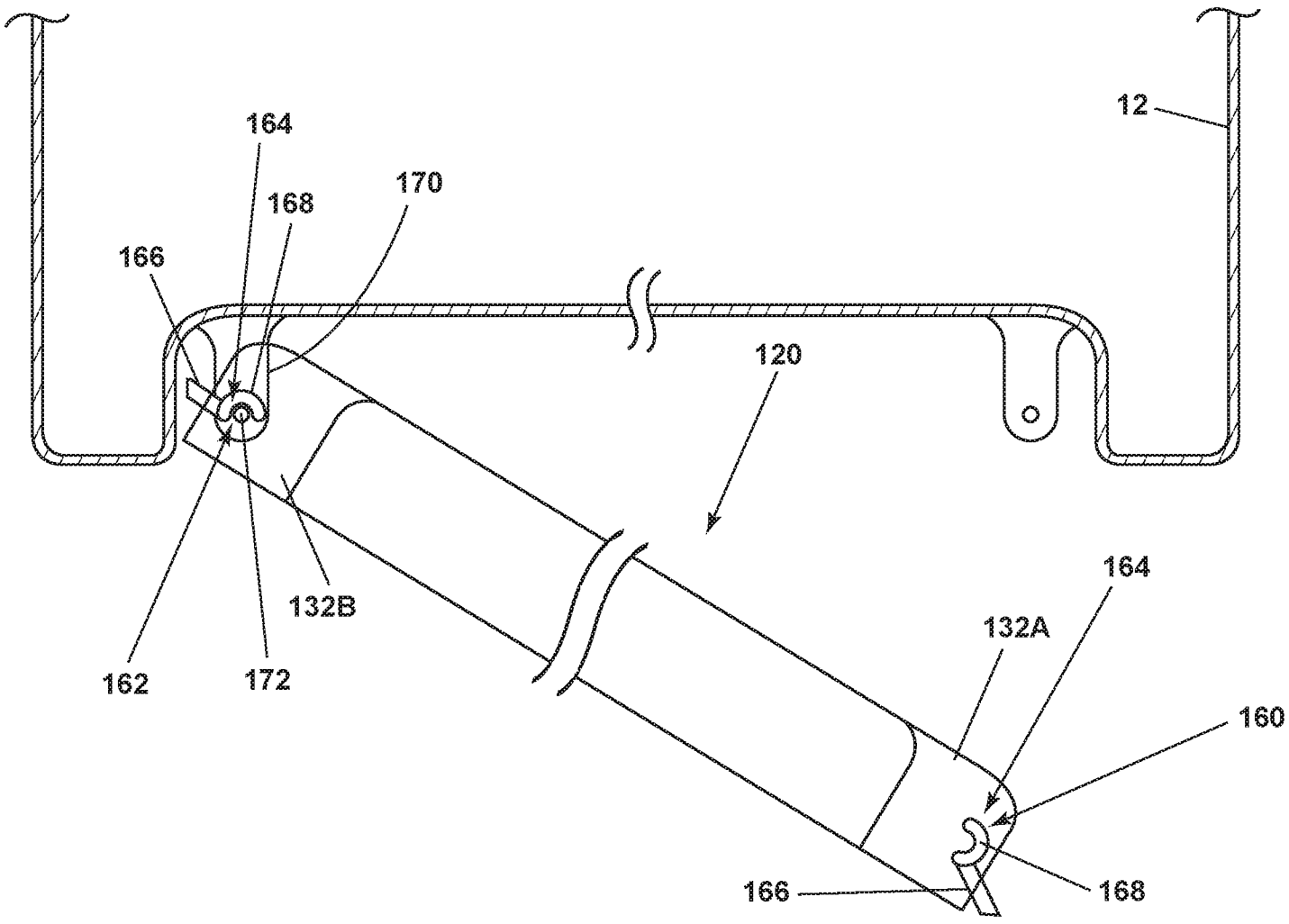
FIG. 5C is a top view of the door of FIG. 5A in an alternate opened position, pivoted about a left-side axis.

Referring now to FIG. 5C, the right-side hinge assembly 162 has been actuated to decouple the three-way door 120 from the cabinet 12 at the right side, similar to that of the left-side hinge assembly 160 of FIG. 5B. The lever 166 has been actuated on the right-side hinge assembly 162 to release the cam 168, permitting pivoting movement of the three-way door 120 about the hinge pin 172 on the left side hinge assembly 160. Thus, the user can use the right-side hinge assembly 162 to open the three-way door 120 in a direction from right-to-left.

Figure 5D:
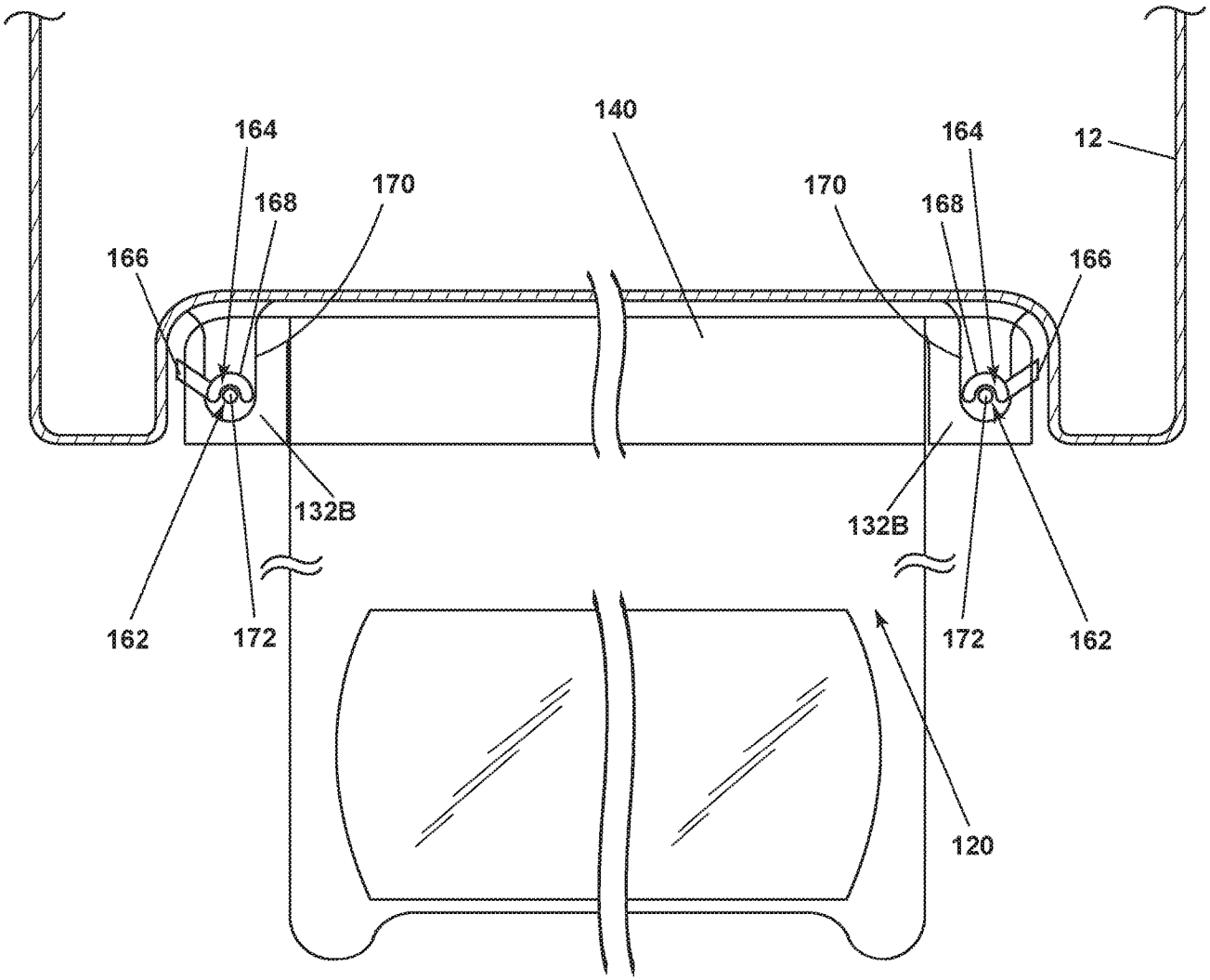
FIG. 5D is a top view of the door of FIG. 5A in another alternate opened position, pivoted about a horizontal, bottom axis.

Referring now to FIG. 5D, both the right and left-side hinges 160, 162 remain coupled to the cabinet 12, with the secondary door 134 pivoted about the horizontal hinge 140 into the opened position as shown in FIG. 4. Thus, as shown in FIGS. 5B-5D, it should be appreciated that the user can open the three-way door 120 in three different ways. Across the rotational axes 154A, 154B of FIG. 4, from right-to-left, left-to-right, and from front-to-back along the horizontal axis 142. This enables any organization of a fabric treating appliance relative to another appliance, wall, or other cabinetry, without requiring a user to place the appliance while contemplating how to open the appliance to provide easy access to the treating chamber.

Additionally, it should be appreciated that the left-side and right side hinge assemblies 160, 162 are not limited as shown. The lever 166 and cam 168 system for selectively coupling the hinge pin 172 is but one example of a method for opening the three-way door 120 form either side. In another example, handles can pivot about a hollow rod replacing the hinge pin 172 extending along the rotational axes 154A, 154B. A retractable pin can be provided in the left and right side hinge assemblies that is slidable along the hollow rod, to selectively engage or disengage the hollow rod, releasing the handles at the hollow rod to open the door in the right-to-left or left-to-right directions. Further still, the hinges can be selectively de-coupled and coupled in other ways. In another example, each handle can include an actuator, such as a push button, which can selectively decouple the correct hinge assembly from the cabinet 12 to enable opening of the three-way door 120 from the handle. For example, a button provided on the left-side handle can selectively decoupled the left-side handle to enable opening of the door about the right-side hinge. Such a button could selectively decouple the hinges electronically. For example, pushing the button can send an electrical signal to the controller 96. The controller 96 would send a signal to an electrically driven mechanical element to release the hinge at the button. Alternatively, actuating the button on the left-side handle can selectively couple or lock the right-side hinge to enable opening of the three-way door solely from the left-side handle.

In yet another example, the user interface of the washing machine 10 can include buttons or a control system, such as a touch screen panel user interface 98, enabling a user to select an opening direction or method. As such, the hinges can be communicatively and electrically coupled to the control panel, to enable mechanical coupling or de-coupling of the hinges to limiting opening of the three-way door 120 in the proper direction. For example, if the washing machine 10 was place on the left side of a dryer, it would be desirable for the user to open the door from right-to-left, or horizontally, so as to not interfere with opening the machines simultaneously. A user could select on the user interface 98 to enable opening only to the left side. However, if the user wanted to change the direction of opening, operation of the user interface 98 would permit easy set-up of the opening direction. Further, the proper opening direction could be identified for the user. In one example, indicia could be used to identify where to open the three-way door from, or which direction to move the door. In another example, lights, such as LEDs, or even a display could be installed on the machine to identify where the user can grab the three-way door 120 where opening is enabled, and which direction the user can pull the door.

Additionally, the three-way door 120 can include a system to prevent improper opening of the door after it has been opened in one direction. For example, when a user opens the door from left-to-right by actuating the left-side hinge assembly 160, rotating about the right side hinge assembly 162, the three-way door 120 can be locked, preventing release of the right-side hinge assembly 162, where the door would fully detach from the washing machine, or from the door falling down, pivoting about the horizontal hinge 140. In order to do so, the two, un-actuated hinges, would lock upon actuation of the remaining hinge. Looking again at FIG. 5C, upon actuation of the right-side hinge assembly 162, the left side hinge assembly 160 and the horizontal hinge would lock, preventing actuation of those hinges until the right-side hinge assembly has been returned to a closed position. Locking of the remaining hinge assemblies could be accomplished through mechanical means, coupled to the actuated hinge and locked at actuation of the initial hinge assembly. Alternatively, the locking of the remaining hinges could be accomplished electronically. For example, a signal could be sent to the controller upon actuation of one hinge. The controller would send another signal to the remaining hinges to lock, preventing actuation. Such could be accomplished by a mechanical lock. When the initial hinge is returned to a closed position, another signal would be provided to the controller. The controller would then send another signal to the remaining hinges to unlock, permitting potential actuation to all hinges. In the example where the user selects a predetermined opening direction, the controller could permanently lock the two unselected hinges until the user changes the predetermined opening direction.

Further still, it is contemplated that the three-way door 120 can be utilized on a top-load machine, with the three-way door 120 laying horizontally over the treating chamber 18. Such a three-way door would permit the user to open the door in the three directions. This may be desirable to open in the proper direction to access the treating chamber without blocking a rear-mounted user interface. A typical top-loading door pivots from front to back, often blocking the user interface. Permitting three-way movement can prevent blocking of the user interface as well as a preferred opening direction based upon user preference or surrounding structures.

The previously described washing machine 10 can be used to implement one or more embodiments of a door assembly, such as a triple-axis door assembly that can be opened from the left hand side of the door (pivot axis on right side of the door), or, opening from the right hand side of the door (pivot axis on the left side of the door), or the user can rotate the door down (drop down/hamper style with the pivot axis running horizontally at the bottom of the door assembly) which permits a better user experience when the appliance is next to a top loading washing unit.

The ability for the consumer to change the pivot axis on the dryer door is desired in the event that the consumer places the washing machine to the left of the washer due to utilities or other constraints. Today, the typical washer comes standard with the door pivot axis on the right hand side of the machine with the assumption the dryer will be installed to the right of the washer. Some manufacturers design the washing machine door to be consumer removable, and reconfigurable so that the door hinge is placed onto the left hand side of the machine if the consumer installs the matching dryer to the left of the washer. Also, some consumers prefer for personal reasons for the door to open on the opposite side as assembled by the manufacturer. Regardless of the reason for the repositioning/reconfiguration of the door, the repositioning/reconfiguration is time consuming and laborious for most consumers. Most washing machine appliances come with a side opening door design. If the consumer has a top loading washer, the side opening design is not necessarily ideal due to the laundry coming out the top of the washer and going into the dryer from an elevated position. For the vertical axis washer, a dryer with a drop down or hamper style door can be desirable to some users. The current side opening door designs cannot be reconfigured to support a drop down door configuration. In addition, to permit the consumer to reverse the hinge side of the washing machine door, the door must include removable fasteners and components that can be taken from one side of the door and positioned the same, on the opposite side of the door. This consumer reversibility (L/R) is not preferred from an aesthetic point of view.

The door assembly as described herein is a true three-way (left/right/up/down) operational door configuration. The three-way door would permit the consumer to engage a handle on either the left side of the machine (dryer to the right of the washer), or a handle on the right side of the machine (dryer to the left of the washer) or, pull down the door via a handle at the top of the door (dryer could be either side of the washer—Vertical axis washer-matching dryer). The design as described herein would not require the consumer to modify the door. Rather, the door would operate in any of the three rotational axis depending on the consumer preference. The drop down door assembly contains all of the door sealing features and window if desired. The drop down door assembly is pivotally attached and secured (spring catch) to the primary door assembly. The left and right pivot able assembly remains fixed to the appliance if the user chooses to pull the door down in support of the drop down door configuration. If the user selects the left hand handle to open the door, the primary door assembly which includes the drop down door pivot about the right hand axis. If the user selects the right hand handle to open the door, the primary door assembly which includes the drop down door pivot about the left hand axis. This door design is most favorable for a laundry dryer appliance as it permits any consumer positioning relative to the washing machine and supports a common dryer door assembly shared between a horizontal axis washer and a vertical axis washer. This three-way door could also be used for other appliances requiring entrance doors. Since the proposed three-way door does not need to be adjusted or physically modified by the consumer to permit multi-axis use, the door can be designed with improved aesthetics due to the removal of consumer accessible fasteners, etc.

Although the embodiment of the present invention have been shown and described, it would be appreciated by those skilled in the art that changes may be made in these embodiments without departing from the principles and spirit of the invention, the scope of which is defined in the claims and their equivalents.

What is claimed is:

1. A laundry treating appliance comprising:

a cabinet defining an interior having a front access opening;

a drum provided in the interior defining a treating chamber accessible through the access opening; and a three-way door assembly selectively opening/closing the access opening, and comprising:

a first door pivotable about a left-side vertical axis defining a first way of opening and a right-side vertical axis defining a second way of opening; and a second door provided within and partially forming the first door, and pivotable about a horizontal axis defining a third way of opening, wherein a user can open the three-way door assembly in any of the first way of opening, the second way of opening, or the third way of opening at the user's preference without mechanically altering the door to enable opening in the first, second, and third ways of opening.

2. The laundry treating appliance of claim 1 wherein the first door further comprises a first hinge assembly releasably and hingedly coupling the first door to the cabinet along the left-side vertical axis, and a second hinge assembly releasably and hingedly coupling the first door to the cabinet and defining the right-side vertical axis.

3. The laundry treating appliance of claim 2 wherein the second door further comprises a horizontal hinge defining the horizontal axis.

4. The laundry treating appliance of claim 3 wherein the horizontal hinge is damped.

5. The laundry treating appliance of claim 3 wherein the second door includes a releasable latch for holding the second door in a closed position.

6. The laundry treating appliance of claim 5 wherein the second door includes a hand opening for opening the second door.

7. The laundry treating appliance of claim 3 wherein the first door further comprises a left handle housing the first hinge assembly and a right handle housing the second hinge assembly.

8. The laundry treating appliance of claim 7 wherein the horizontal hinge extends between the left handle and the right handle.

9. The laundry treating appliance of claim 7 wherein the left handle is pivotable about the left-side vertical axis and the right handle is pivotable about the right-side vertical axis.

10. The laundry treating appliance of claim 9 wherein the left handle includes a first release lever and the right handle includes a second release lever.

11. The laundry treating appliance of claim 10 wherein the left handle includes a left hand opening for accessing the first release lever and the right handle includes a right hand opening for accessing the second release lever.

12. A laundry treating appliance comprising:

a cabinet defining an interior having an access opening;

a drum provided in the interior defining a treating chamber accessible through the access opening; and a door assembly selectively opening/closing the access opening, and comprising:

a first door pivotable about a first axis defining a first way of opening and a second axis defining a second way of opening, which is different from the first axis; and a second door provided within and partially forming the first door, and pivotable about a third axis defining a third way of opening, which is different from the first and second axes;

wherein the door assembly is openable about the first way of opening, the second way of opening, and the third way of opening to define a three-way operational door configuration without requiring a user to mechanically alter the door to enable opening in the first, second, and third way of opening.

13. The laundry treating appliance of claim 12 wherein the first door further comprises a first hinge assembly coupling the first door to the cabinet along the first axis, and a second hinge assembly coupling the first door to the cabinet along the second axis.

14. The laundry treating appliance of claim 13 further comprising a third hinge assembly along the third axis extending between the first and second hinge assemblies.

15. A three-way door assembly for opening/closing an appliance in three directions, and including a cabinet defining an interior including an access opening for accessing the interior, the three-way door assembly comprising:

a first door selectively pivotable about both of a left-side vertical axis and a right-side vertical axis; and a second door provided within the first door and pivotable about a horizontal axis;

wherein the three-way door assembly is selectively openable in three directions about any of the left-side vertical axis, the right-side vertical axis, and the horizontal axis without requiring a user to mechanically alter the door.

16. The three-way door assembly of claim 15 wherein the three directions include a drop-down direction, a left-to-right direction, and a right-to-left direction.

17. The three-way door assembly of claim 15 further comprising a first hinge assembly defining the left-side vertical axis, a second hinge assembly defining the right-side vertical axis, and a third hinge defining the horizontal axis.

18. The three-way door assembly of claim 17 wherein the first door further comprises a left handle housing the first hinge assembly and a right handle housing the second hinge assembly.

19. The three-way door assembly of claim 18 wherein the third hinge extends between the left handle and the right handle.

20. The three-way door assembly of claim 19 wherein the left handle is pivotable about the left-side vertical axis and the right handle is pivotable about the right-side vertical axis.

* * * * *